US011236919B2

(12) United States Patent
Zhai et al.

(10) Patent No.: US 11,236,919 B2
(45) Date of Patent: Feb. 1, 2022

(54) HEAT EXCHANGING UNIT, A HEAT EXCHANGING SYSTEM AND A METHOD OF DETERMINING FAILURE OF A CONTROL VALVE THEREIN

(71) Applicant: Carrier Corporation, Palm Beach Gardens, FL (US)

(72) Inventors: Hui Zhai, Shanghai (CN); Guangyu Shen, Shanghai (CN); Qing Liu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/913,746

(22) Filed: Jun. 26, 2020

(65) Prior Publication Data

US 2021/0010705 A1 Jan. 14, 2021

(30) Foreign Application Priority Data

Jul. 3, 2019 (CN) ..... 201910594165.9

(51) Int. Cl.
*F24F 11/38* (2018.01)
*F24F 11/84* (2018.01)
*F24F 110/10* (2018.01)

(52) U.S. Cl.
CPC ..... *F24F 11/38* (2018.01); *F24F 11/84* (2018.01); *F24F 2110/10* (2018.01)

(58) Field of Classification Search
CPC ..... F24F 11/38; F24F 5/0003; F24F 1/0003; F25B 13/00; Y02B 30/70
See application file for complete search history.

(56) References Cited

U.S. PATENT DOCUMENTS

| | | | | |
|---|---|---|---|---|
| 5,927,087 | A * | 7/1999 | Ishikawa | F25B 41/20 62/174 |
| 8,961,708 | B2 | 2/2015 | Kaiser et al. | |
| 9,631,833 | B2 | 4/2017 | Arensmeier et al. | |
| 9,741,023 | B2 | 8/2017 | Arensmeier et al. | |
| 10,156,378 | B2 | 12/2018 | Arensmeier et al. | |
| 10,234,854 | B2 | 3/2019 | Arensmeier | |

(Continued)

FOREIGN PATENT DOCUMENTS

KR 1020100081620 A 7/2010

OTHER PUBLICATIONS

United Kingdom Search Report for Application No. GB2009918.0; dated Nov. 27, 2020; 6 Pages.

*Primary Examiner* — Santosh R Poudel
(74) *Attorney, Agent, or Firm* — Cantor Colburn LLP

(57) ABSTRACT

A heat exchange unit, a heat exchange system, and a method of determining the failure of a control valve in the heat exchange system. The heat exchange unit includes: a first flow path; and a second flow path at least partially located within the first flow path to exchange heat with the first flow path, one of the inlet and the outlet of the second flow path being connected to the main flow path of the external heat exchange system through a control valve; a first temperature sensor at the inlet of the first flow path to sense a first temperature $T_1$; a second temperature sensor at the outlet of the first flow path or the second flow path within the first flow path to sense a second temperature $T_2$; and a processor configured to determine whether the control valve fails.

8 Claims, 3 Drawing Sheets

(56) References Cited

U.S. PATENT DOCUMENTS

| | | | | |
|---|---|---|---|---|
| 10,274,945 | B2 | 4/2019 | Arensmeier et al. | |
| 2007/0113568 | A1* | 5/2007 | Jang | F25B 41/31 62/222 |
| 2010/0174412 | A1* | 7/2010 | Kwon | F24F 11/30 700/275 |
| 2017/0268811 | A1* | 9/2017 | Ochiai | F25B 49/005 |
| 2017/0292725 | A1* | 10/2017 | Conley | G05B 19/048 |
| 2019/0242603 | A1* | 8/2019 | Wei | F24F 11/89 |
| 2020/0256590 | A1* | 8/2020 | Nishiyama | F25B 13/00 |

* cited by examiner

HEAT EXCHANGING UNIT, A HEAT EXCHANGING SYSTEM AND A METHOD OF DETERMINING FAILURE OF A CONTROL VALVE THEREIN

FOREIGN PRIORITY

This application claims priority to Chinese Patent Application No. 201910594165.9, filed Jul. 3, 2019, and all the benefits accruing therefrom under 35 U.S.C. § 119, the contents of which in its entirety are herein incorporated by reference.

TECHNICAL FIELD

The present invention relates to the field of heat exchange system, and more particularly, the present invention relates to an apparatus and method for determining the failure of control valve of an indoor unit in a heat exchange system.

BACKGROUND TECHNIQUE

Each indoor unit of a heat exchange system connects to a main flow path through a control valve, such that they may be selectively opened or closed. The control valve is, for example, a solenoid valve or a thermoelectric water valve, which is connected in the pipeline. The control valve may experience connection failure or mechanical failure during long-term use. Common indoor units generally do not include automatic failure checking function for the control valve. Therefore, it is difficult to find when the control valve fails, which may lead to user discomfort and product performance degradation.

SUMMARY OF THE INVENTION

An object of the present invention is to solve or at least alleviate the problems existing in the prior art.

According to some aspects, a heat exchange unit is provided, including: a first flow path; and a second flow path at least partially located within the first flow path to exchange heat with the first flow path, one of the inlet and the outlet of the second flow path being connected to the main flow path of an external heat exchange system through a control valve; a first temperature sensor at the inlet of the first flow path to sense a first temperature $T_1$; a second temperature sensor at the outlet of the first flow path or at the second flow path within the first flow path to sense a second temperature $T_2$; and a processor configured to determine whether the control valve fails according to the difference between the first temperature $T_1$ and the second temperature $T_2$ when the heat exchange unit is connected to the main flow path.

Optionally, in the heat exchange unit, the second temperature sensor is provided at the outlet of the first flow path to sense an outlet second temperature $T_{22}$, and the processor determines whether the control valve fails by comparing the magnitude relationship of the absolute value of $T_1$-$T_{22}$ with a predetermined temperature $T_0$ when the control valve is in open or closed state, when the control valve is in open state, $|T_1-T_{22}|<T_0$ and such condition lasts for a predetermined time, it is determined that the control valve fails; or when the control valve is in closed state, $|T_1-T_{22}|\geq T_0$ and such condition lasts for a predetermined time, it is determined that the control valve fails.

Optionally, in the heat exchange unit, the second temperature sensor is disposed on the second flow path within the first flow path to sense a middle second temperature $T_{21}$, the processor determines whether the control valve is operating normally by comparing the magnitude relationship of the absolute value of $T_1$-$T_{21}$ with the absolute value of $T_{21}$-$T_3$ when the control valve is in open or closed state, when the control valve is in open state, $|T_1-T_{21}|<|T_{21}-T_3|$ and such condition lasts for a predetermined time, it is determined that the control valve fails; when the control valve is in closed state, $|T_1-T_{21}|\geq|T_{21}-T_3|$ and such condition lasts for a predetermined time, it is determined that the control valve fails, wherein the third temperature $T_3$ is the fluid temperature of the main flow path, optionally, the processor has a port to receive the third temperature $T_3$.

Optionally, in the heat exchange unit, the processor determines whether the control valve fails each time when the state of the control valve changes and a stable time elapses.

On the other hand, a heat exchange system is provided, the heat exchange system includes the heat exchange unit according to various embodiments, and more specifically, the heat exchange system includes: a driving device, one or more outdoor units and one or more indoor units connected in the main flow path, wherein at least one of the one or more indoor units is a heat exchange unit according to various embodiments, optionally, the processor connects to the outdoor unit to read the third temperature $T_3$.

On the other hand, a method for determining the failure of a control valve in a heat exchange system is provided, the heat exchange system includes a heat exchange unit comprising: a first flow path; and a second flow path at least partially located within the first flow path to exchange heat with the first flow path, one of the inlet and the outlet of the second flow path being connected to the main flow path of the heat exchange system through the control valve; the method includes: obtaining a first temperature $T_1$ at the inlet of the first flow path; obtaining a second temperature $T_2$ at the outlet of the first flow path or at the second flow path within the first flow path; and determining whether the control valve fails according to the difference between the first temperature $T_1$ and the second temperatures $T_2$.

Optionally, the method includes: obtaining an outlet second temperature $T_{22}$ at the outlet of the first flow path, and determining whether the control valve fails by comparing the magnitude relationship between the absolute value of $T_1$-$T_{22}$ and the predetermined temperature $T_0$ when the control valve is in open or closed state, when the control valve is in open state, $|T_1-T_{22}|<T_0$ and such condition lasts for a predetermined time, it is determined that the control valve fails; or when the control valve is in closed state, $|T_1-T_{22}|\geq T_0$ and such condition lasts for a predetermined time, it is determined that the control valve fails.

Optionally, the method includes: obtaining a middle second temperature $T_{21}$ at the second flow path within the first flow path, and determining whether the control valve is operating normally by comparing the magnitude relationship between the absolute values of $T_1$-$T_{21}$ with the absolute value of $T_{21}$-$T_3$ when the control valve is in open or closed state, when the control valve is in open state, $|T_1-T_{21}|<|T_{21}-T_3|$ and such condition lasts for a predetermined time, it is determined that the control valve fails; when the control valve is in closed state, $|T_1-T_{21}|\geq|T_{21}-T_3|$ and such condition lasts for a predetermined time, it is determined that the control valve fails, wherein the third temperature $T_3$ is the fluid temperature of the main flow path.

Optionally, the heat exchange system includes: a driving device, one or more outdoor units, and one or more indoor units connected by the main flow path, the method includes: obtaining the third temperature $T_3$ from the outdoor unit.

Optionally, the method includes determining whether the control valve fails each time the state of the control valve changes and a stable time elapses.

A method of determining the failure of a control valve in a heat exchange system, the heat exchange system includes a heat exchange unit, the heat exchange unit includes: a first flow path; and a second flow path at least partially located within the first flow path to exchanges heat with the first flow path, an inlet or an outlet of the second flow path being connected to the main flow path of the heat exchange system through the control valve; the method includes: obtaining a first temperature $T_1$ at the inlet of the first flow path; obtaining a second temperature $T_2$ at the outlet of the first flow path or at the second flow path within the first flow path; and determining whether the control valve fails by the difference between the first temperature $T_1$ and the second temperature $T_2$.

The method and apparatus according to the embodiments of the present invention achieve automatic determination of the failure of control valve.

BRIEF DESCRIPTION OF DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein.

DETAILED DESCRIPTION OF EMBODIMENTS

Figure 1:
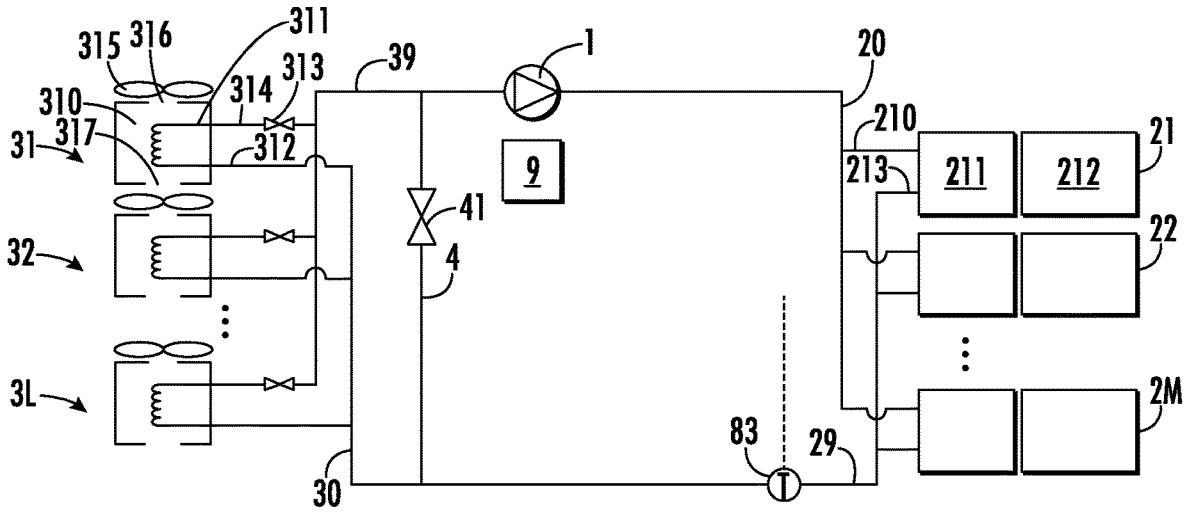
FIG. 1 shows a schematic diagram of a heat exchange system according to an embodiment of the present invention.

It is easy to understand that, according to the technical solution of the present invention, the person skilled in the art may propose a variety of mutually replaceable structural configuration and implementation methods without changing the essential spirit of the present invention. Therefore, the following specific embodiments and the accompanying drawings are merely exemplary illustrations of the technical solutions of the present invention, and should not be regarded as the entirety of the present invention or regarded as definition or limitation to the technical solutions of the present invention.

The terms of orientation mentioned herein, such as up, down, left, right, front, back, front face, rear face, top, bottom, etc., are defined relative to the structure shown in the drawings. They are relative concepts, so they may change accordingly according to their different locations and different use states. Therefore, these or other orientation terms should not be construed as restrictive terms.

Figure 2:
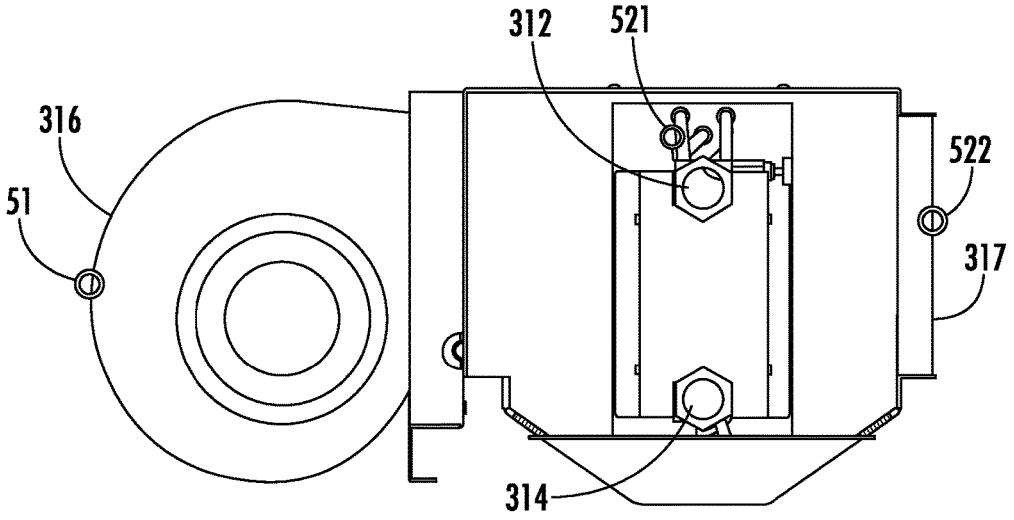
FIG. 2 is a cross-sectional view of an indoor unit according to an embodiment of the present invention.

Referring first to FIGS. 1 and 2, a heat exchange system and a heat exchange unit according to an embodiment of the present invention are shown, respectively. The heat exchange system may include: a driving device 1 (such as a driving pump), one or more outdoor units 21, 22 . . . 2M, and one or more indoor units 31, 32 . . . 3L connected by pipelines. The bypass line 4 which may be provided with a bypass valve 41 is connected in parallel with the plurality of indoor units 31, 32 . . . 3L. Cooling medium, such as water, flow in the thermal circulation system to adjust the temperature. In the illustrated embodiment, each outdoor unit may be connected in parallel between the outdoor unit inlet main pipeline 20 and the outdoor unit outlet main pipeline 29, for example. The outdoor units 21, 22 . . . 2M may include a heat exchanger 211 connected to the outdoor unit inlet main pipeline 20 and the outdoor unit outlet main pipeline 29 and an external circulation mechanism 212. The heat exchanger 211 may be, for example, a plate heat exchanger, which has a cooling medium inlet 210 and a cooling medium outlet 213. The heat exchanger 211 absorbs heating capacity or cooling capacity from the refrigerant in the external circulation mechanism 212. The external circulation mechanism 212 may include a compressor, a heat exchanger, an expansion valve, refrigerant, and the like. Each indoor units 31, 32 . . . 3L are connected to the main flow path of the heat exchange system through the control valve 313, and are arranged at different areas of the building, for example. By opening or closing the control valve 313, it is independently controlled whether the heat exchange unit in each area operates, such as delivering the cooling capacity or heating capacity carried by the cooling medium to each area. Each indoor unit may be connected in parallel between the indoor unit inlet main pipeline 30 and the indoor unit outlet main pipeline 39, and may include a heat exchange unit including: a first flow path 310; and a second flow path 311 at least partially located within the first flow path 310 in order to exchange heat with the first flow path 310. The first flow path 310 may be a gas flow path and a fan 315 may be provided at the inlet or the outlet thereof to drive the gas to flow through the first flow path, while the second flow path may be a cooling medium flow path, which is, for example, a coil that enters into the first flow path 310. One of the inlet 312 and the outlet 314 of the second flow path is connected to the main flow path through the control valve 313, more specifically, in the illustrated embodiment, the inlet 312 of the second flow path is connected to the indoor unit inlet main pipeline 30 and the outlet 314 of the second flow path is connected to the indoor unit outlet main pipeline 39 through a control valve 313. In an alternative embodiment, the control valve may also be provided between the inlet 312 of the second flow path and the indoor unit inlet main pipeline 30.

As shown in FIG. 2, a first temperature sensor 51 is provided at the first flow path inlet 316 to sense the first temperature $T_1$; a second temperature sensor may be provided at the first flow path outlet or at the second flow path within the first flow path (in other words, at least a portion of the second flow path located within the first flow path) to sense the second temperature $T_2$. As an example, a second temperature sensor 522 may be provided at the first flow path outlet 317 to sense the second temperature $T_2$ (for the sake of clarity, the second temperature here can also be referred to as the outlet second temperature, and can be referred to as $T_{22}$), or a second temperature sensor 521 may be provided at the second flow path within the first flow path (such as at outer side of a U-shaped joint of the coil) to sense the second temperature $T_2$ (for the sake of clarity, the second temperature here may also be referred to as the middle second temperature, and may be referred to as $T_{21}$). The heat exchange unit further includes a processor 9 configured to determine whether the control valve 313 fails based on the difference between the first temperature $T_1$ and the second temperature $T_2$ when the heat exchange unit is connected to the heat exchange system. The embodiments according to the present invention determine whether the control valve on the second flow path operates normally based on the temperature difference between the first flow path inlet and the second flow path within the first flow path or the temperature difference between the first flow path inlet and the first flow path outlet. Merely two temperature sensors and one processor 9 are required to be added into the original heat exchange unit, or the original processor 9 in the system can be programmed to achieve the function of automatically judging the failure of the control valve. The whole solution is easy to implement and low cost. On the other hand, it is also easy to retrofit the existing unit to achieve this function.

Figure 3:
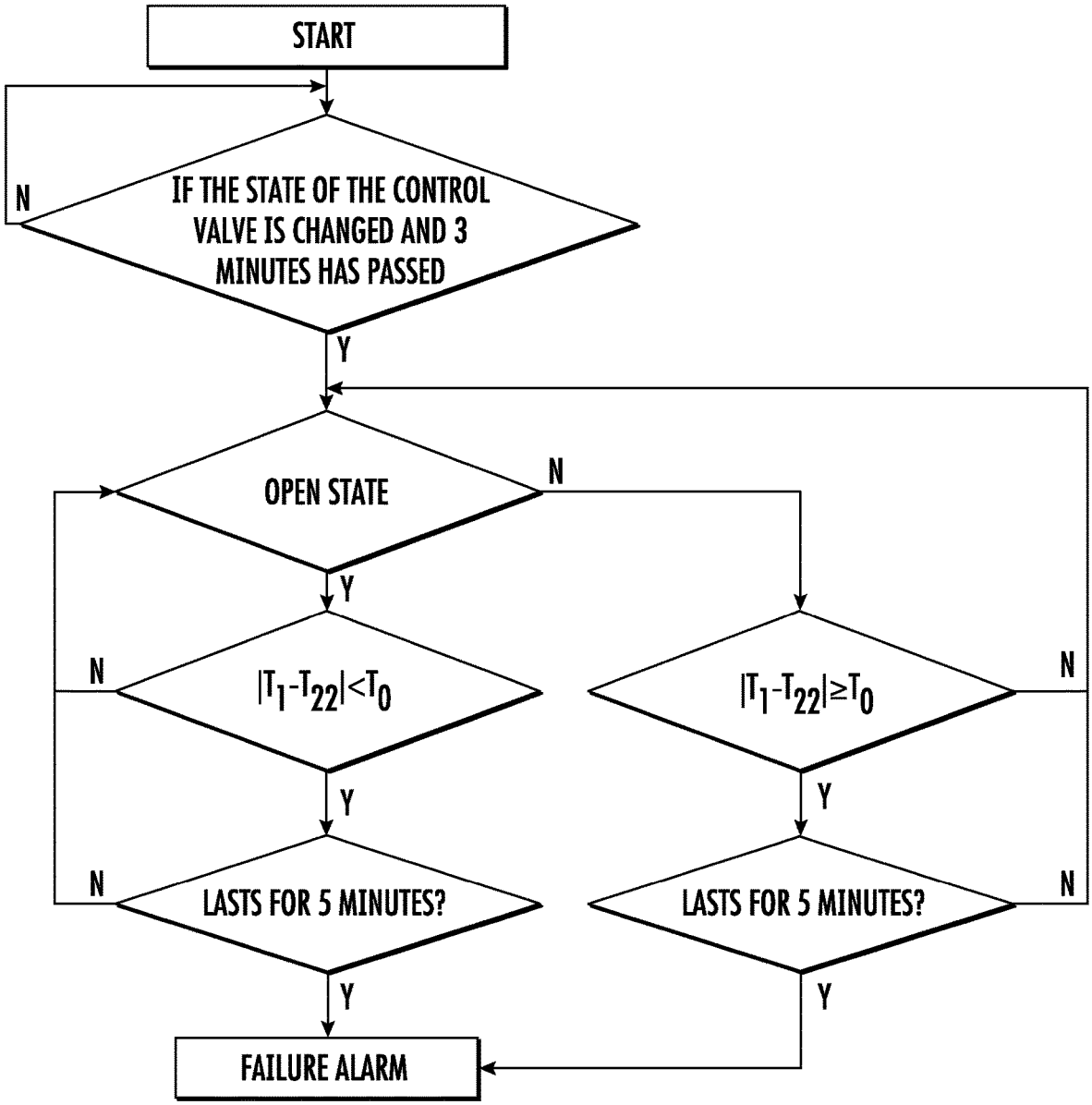
FIGS. 3 and 4 are flow charts of the methods according to embodiments of the present invention.

Referring to FIG. 3, it is shown that the second temperature sensor 522 is provided at the outlet 317 of the first flow path, that is, by comparing the temperature difference between the inlet and the outlet of the first flow path to determine whether the control valve is operating normally. As described above, the second temperature sensed by the second temperature sensor 522 at this time is also referred to as the outlet second temperature, and may be denoted as $T_{22}$. In this case, the processor 9 can conduct failure judgment each time the state of the control valve changes, that is, to activate the judgment program by a state changing instruction of the control valve, so as to confirm whether the control valve operates normally each time the control valve switches the working state. In some embodiments, the processor 9 may conduct judgment after a control valve working state switching instruction is sent and after a continuing stabilization time elapses, for example, the stabilization time may be set to 3 minutes, 4 minutes, 5 minutes or more, so as to collect the temperature information after the working state of the control valve is switched and the system is stabilized, such that the judgment is more accurate. In some embodiments, the processor 9 compares the magnitude relationship of the absolute value of $T_1$-$T_{22}$ with the predetermined temperature $T_0$ to determine whether the control valve fails. When the control valve is in open state, $|T_1-T_{22}|<T_0$ and lasts for a predetermined time, such as 5 minutes, it is determined that the control valve fails, otherwise it is considered that the control valve is operating normally; or when the control valve is in closed state, $|T_1-T_{22}|\geq T_0$ and lasts for a predetermined time, such as 5 minutes, it is determined that the control valve fails, otherwise it is considered that the control valve is operating normally. The predetermined temperature $T_0$ may be a determined value, such as set based on experience or the predetermined temperature $T_0$ may be a function of parameters such as the main flow path fluid temperature, the thermostat setting temperature, and/or the control valve opening degree, and the like. In some embodiments, the predetermined time can be set as required to adjust the sensitivity of the system.

Figure 4:
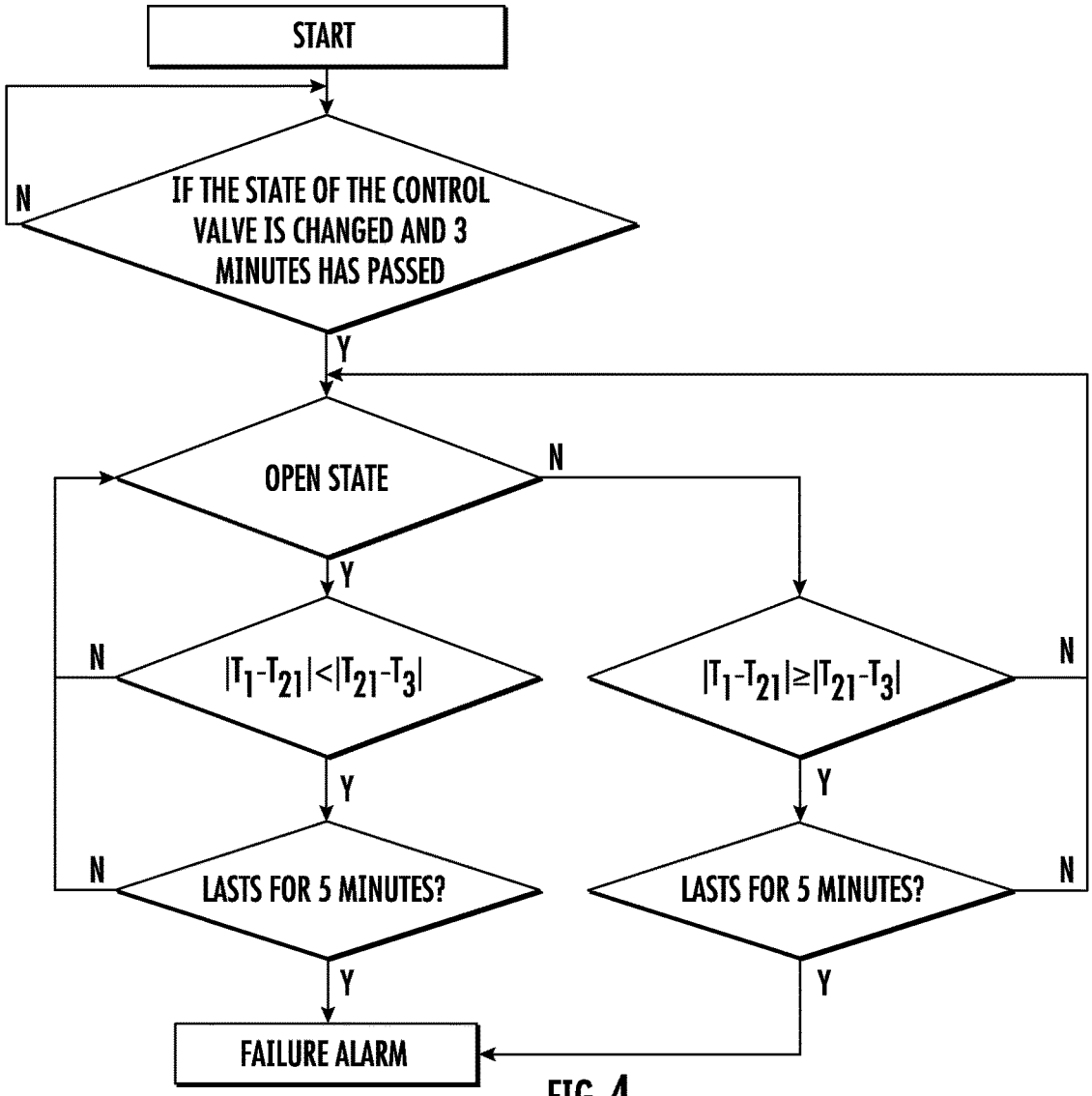

Continuing to refer to FIG. 4, which shows the flow chart of another determination method, in which the second temperature sensor 521 is provided at the second flow path within the first flow path, for example, on the outer side of the coil of the second flow path. As described above, the second temperature sensed by the second temperature sensor 521 at this time is also referred to as the middle second temperature, and may be denoted as $T_{21}$. This judgment process is similar to the method described with reference to FIG. 3, the difference is that the processor 9 determines whether the control valve is operating normally based on the magnitude relationship between the absolute value of $T_1$-$T_{21}$ and the absolute value of $T_{21}$-$T_3$ when the control valve is in open or closed state. $T_3$ is the temperature of the main flow path fluid, and the temperature of the fluid in the main flow path can be read by configuring the processor 9 with a port, such as reading from the temperature sensor 83 on the outdoor unit outlet main pipeline 29. For example, in a common heat exchange system, the temperature of the main flow path fluid can be determined by reading the temperature at the outdoor unit. In this control flow chart, when the control valve is in open state, $|T_1-T_{21}|<|T_{21}-T_3|$ and lasts for a predetermined time, it is determined that the control valve fails, otherwise it is considered that the control valve is operating normally; when the control valve is in closed state, $|T_1-T_{21}|\geq|T_{21}-T_3|$ and lasts for a predetermined time, it is determined that the control valve fails, otherwise it is considered that the control valve is operating normally. It should be understood that the above judgments are based on the absolute values of the first temperature $T_1$ and the second temperature $T_2$. This is because the heat exchange system can be operated in cooling or heating mode. If the system is a system that implements only one mode, it may not be required to take the absolute value of the difference.

Figure 5:
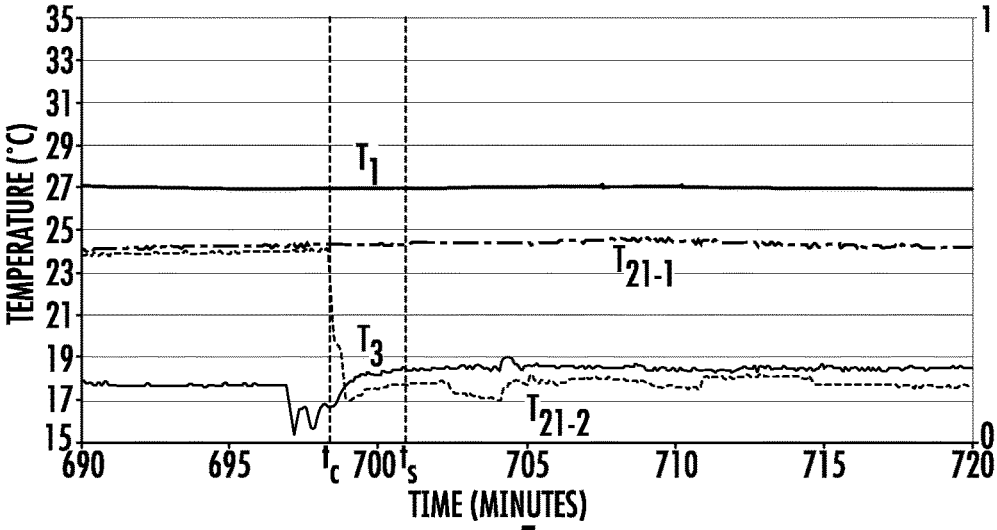
FIG. 5 is the graph of various temperatures of the heat exchange system according to an embodiment of the present invention when the state of the control valve changes.

With continued reference to FIG. 5, which is a curve based on the data of the embodiment of FIG. 4, in this curve, $t_0$ is the opening time of the control valve, $t_1$ is the stabilized time, $T_{21}$-1 is the second temperature curve when the control valve fails and $T_{21}$-2 is the second temperature curve during normal operation of the control valve. It can be seen from the drawing that after the control valve is opened, under normal condition, the temperature of the second pipeline is closer to $T_3$, that is, $|T_1-T_{21}|>|T_{21}-T_3|$, if the control valve is not opened due to failure, the second pipeline will not in communicate with the main flow, so the temperature of the second pipeline is closer to $T_1$, that is, $|T_1-T_{21}|<|T_{21}-T_3|$, which shows that the control valve has failed.

On the other hand, a heat exchange system and a method of determining the failure of the control valve in the heat exchange system are provided.

The specific embodiments described above are merely to more clearly describe the principle of the present invention, wherein various components are clearly shown or described to make the principle of the present invention easier to understand. Those skilled in the art can easily make various modifications or changes to the present invention without departing from the scope of the present invention. Therefore, it should be understood that these modifications or changes should be included within the patent protection scope of the present invention.

What is claimed is:

1. A heat exchange unit, characterized in that it comprises:

a first flow path; and a second flow path at least partially located within the first flow path to exchange heat with the first flow path, one of the inlet and the outlet of the second flow path being connected to a main flow path of an external heat exchange system through a control valve;

a first temperature sensor at the inlet of the first flow path to sense a first temperature $T_1$;

a second temperature sensor at the outlet of the first flow path or at the second flow path within the first flow path to sense a second temperature $T_2$; and a processor configured to determine whether the control valve fails according to the difference between the first temperature $T_1$ and the second temperature $T_2$ when the heat exchange unit is connected to the main flow path;

wherein the second temperature sensor is provided at the outlet of the first flow path to sense an outlet second temperature $T_{22}$, and the processor determines whether the control valve fails based on comparing the magnitude relationship between the absolute value of $T_1$-$T_{22}$ and the predetermined temperature $T_0$ when the control valve is in open or closed state, when the control valve is in open state, $|T_1-T_{22}|<T_0$ and lasts for a predetermined time, it is determined that the control valve fails; and when the control valve is in closed state, $|T_1-T_{22}|\geq T_0$ and lasts for a predetermined time, it is determined that the control valve fails.

2. The heat exchange unit according to claim 1, wherein the processor determines whether the control valve fails each time the control valve state changes and a stable time elapses.

3. A heat exchange system, characterized in that the heat exchange system includes the heat exchange unit according to claim 1, wherein the heat exchange system includes: a driving device, one or more outdoor units and one or more indoor units connected in a main circuit.

4. A heat exchange unit, characterized in that it comprises:

a first flow path; and a second flow path at least partially located within the first flow path to exchange heat with the first flow path, one of the inlet and the outlet of the second flow path being connected to a main flow path of an external heat exchange system through a control valve;

a first temperature sensor at the inlet of the first flow path to sense a first temperature $T_1$;

a second temperature sensor at the outlet of the first flow path or at the second flow path within the first flow path to sense a second temperature $T_2$; and a processor configured to determine whether the control valve fails according to the difference between the first temperature $T_1$ and the second temperature $T_2$ when the heat exchange unit is connected to the main flow path;

wherein the second temperature sensor is provided on the second flow path within the first flow path to sense a middle second temperature $T_{21}$, and the processor determines whether the control valve operates normally based on comparing the magnitude relationship between the absolute value of $T_1-T_{21}$ and the absolute value of $T_{21}-T_3$ when the control valve is in open or closed state, when the control valve is in open state, $|T_1-T_{21}|<|T_{21}-T_3|$ and lasts for a predetermined time, it is determined that the control valve fails; and when the control valve is closed state, $|T_1-T_{21}|\geq T_{21}-T_3|$ and lasts for a predetermined time, it is determined that the control valve fails, wherein the third temperature $T_3$ is the fluid temperature of the main flow path, the processor has a port to receive the third temperature $T_3$.

5. A method for determining the failure of a control valve in a heat exchange system including a heat exchange unit, the heat exchange unit including: a first flow path; and a second flow path at least partially located within the first flow path to exchange heat with the first flow path, one of the inlet and the outlet of the second flow path being connected to a main flow path of the heat exchange system through the control valve; characterized in that the method includes: obtaining a first temperature $T_1$ at the inlet of the first flow path; obtaining a second temperature $T_2$ at the outlet of the first flow path or at the second flow path within the first flow path; and determining whether the control valve fails according to the difference between the first temperature $T_1$ and the second temperature $T_2$;

wherein the method comprises: obtaining an outlet second temperature $T_{22}$ at the outlet of the first flow path, and determining whether the control valve fails by comparing the magnitude relationship of the absolute values of $T_1-T_{22}$ and the predetermined temperature $T_0$ when the control valve is in open or closed state, when the control valve is in open state, $|T_1-T_{22}|<T_0$ and lasts for a predetermined time, it is determined that the control valve fails; and when the control valve is in closed state, $|T_1-T_{22}|\geq T_0$ and lasts for a predetermined time, it is determined that the control valve fails.

6. The method according to claim 5, wherein the method comprises determining whether the control valve fails each time the state of the control valve changes and a stable time elapses.

7. A method for determining the failure of a control valve in a heat exchange system including a heat exchange unit, the heat exchange unit including: a first flow path; and a second flow path at least partially located within the first flow path to exchange heat with the first flow path, one of the inlet and the outlet of the second flow path being connected to a main flow path of the heat exchange system through the control valve; characterized in that the method includes:

obtaining a first temperature $T_1$ at the inlet of the first flow path; obtaining a second temperature $T_2$ at the outlet of the first flow path or at the second flow path within the first flow path; and determining whether the control valve fails according to the difference between the first temperature $T_1$ and the second temperature $T_2$;

wherein the method comprises: obtaining a middle second temperature $T_{21}$ at the second flow path within the first flow path, and determining whether the control valve operates normally by comparing the magnitude relationship of the absolute value of $T_1-T_{21}$ and the absolute value of $T_{21}-T_3$ when the control valve is in open or closed state, when the control valve is in open state, $|T_1-T_{21}|<T_{21}-T_3|$ and lasts for a predetermined time, it is determined that the control valve fails; and when the control valve is in closed state, $|T_1-T_{21}|\geq T_{21}-T_3|$ and lasts for a predetermined time, it is determined that the control valve fails, wherein the third temperature $T_3$ is the fluid temperature of the main flow path.

8. The method of claim 7, wherein the heat exchange system includes:

a drive device, one or more outdoor units, and one or more indoor units connected in the main flow path, the method comprising: obtained the third temperature $T_3$ from the outdoor unit.

* * * * *